United States Patent [19]

Timari

[11] Patent Number: 4,569,270

[45] Date of Patent: Feb. 11, 1986

[54] AUTOMATIC HAND FIREARM

[76] Inventor: Jali Timari, Hatanpäävaltatie 32, SF-33100 Tampere 10, Finland

[21] Appl. No.: 518,797

[22] PCT Filed: Oct. 27, 1982

[86] PCT No.: PCT/FI82/00050

§ 371 Date: Jun. 27, 1983

§ 102(e) Date: Jun. 27, 1983

[87] PCT Pub. No.: WO83/01679

PCT Pub. Date: May 11, 1983

[30] Foreign Application Priority Data

Oct. 28, 1981 [FI] Finland ..... 813366

[51] Int. Cl.[4] ..... F41D 3/00

[52] U.S. Cl. ..... 89/199; 89/184; 89/197

[58] Field of Search ..... 89/199, 180, 184, 190, 89/194, 195, 196, 197; 42/16

[56] References Cited

U.S. PATENT DOCUMENTS

| | | | |
|---|---|---|---|
| 3,430,534 | 3/1969 | Agren | 89/42 |
| 3,651,736 | 3/1972 | Ingram | 89/196 X |
| 3,990,346 | 11/1976 | Irwin | 89/180 |
| 4,335,643 | 6/1982 | Gal | 89/196 |

FOREIGN PATENT DOCUMENTS

| | | | |
|---|---|---|---|
| 2354451 | 5/1975 | Fed. Rep. of Germany | 89/184 |
| 555877 | 11/1958 | Italy | 89/197 |
| 743211 | 1/1956 | United Kingdom | 89/199 |

*Primary Examiner*—David H. Brown
*Assistant Examiner*—John E. Griffiths
*Attorney, Agent, or Firm*—Andrus, Sceales, Starke & Sawall

[57] ABSTRACT

The invention concerns an automatic, mass-obturated hand firearm comprising a body (1) with handle (2), a barrel (3) joined to the body, a breech block (4) with guide (5) constituted by the body and with cocking and firing mechanism (7), the guide of the breech block ascending rearward so that the rearward path of motion of the breech block deviates upward from the centerline (8) of the barrel. The purpose is to eliminate the problem of automatic hand firearms that during shooting the barrel tends to rise upwards.

As taught by the invention, when the breech block (4) is in its forward position its center of gravity (9) is located forward of the handle (2). The breech block (4) is preferably disposed to have its major part forward of the rear end (10) of the barrel (3). Furthermore, the center of gravity (9) of the breech block (4) is preferably located forward of the rear end (10) of the barrel (3). The guide (5) of the breech block (4) forms a preferably obliquely forward and downward inclined surface, against which the breech block rests so that when the rearward directed recoil force acts on the breech block this plug moves rearward and the surface of the breech block hits against the surface of the guide, producing on the body (1) a moment turning downward the muzzle of the barrel (3).

5 Claims, 4 Drawing Figures

AUTOMATIC HAND FIREARM

The present invention concerns an automatic hand firearm.

BACKGROUND OF THE INVENTION

An automatic hand firearm wherein the backward path of motion of the breech block deviates upward from the barrel centre-line is known e.g. through the German application print No. 2 354 451. In this design of prior art in a conventional pistol, where the ammunition box is accommodated in the handle and the breech block has been placed substantially adjacent to the handle or on the rear side thereof, the motion path of the breech block has been disposed to be rearward obliquely ascending, the purpose being to shift the arm's centre of gravity and in particular the barrel as far down as possible so that the barrel might not rise upward when shooting. In practice, the breech block however causes on the rearward obliquely upward pointing breech block guide a downward urging moment behind the weapon's point of support, that is the handle, whereby the butt part of the weapon tends to turn downwards when shooting, which is manifested as a moment lifting the barrel upward. Therefore the effect of the construction is the opposite of that which was aimed at with the construction.

SUMMARY OF THE INVENTION

The object of the present invention is to eliminate the drawback mentioned. In particular, the object of the invention is to provide an automatic mass-obturated hand firearm where the barrel-lifting moment of the recoil has been maximally eliminated.

Regarding the characteristic features of the invention, reference is made to the claims section.

The invention is based on such arrangement of the breech block's centre of gravity and of the breech block guide, such that the breech block, when moving rearward due to the recoil, will give rise to a moment acting forward of this fulcrum point and turning the muzzle of the barrel downward. The said, favorable moment turning the barrel down is produced, as taught by the invention, by arrangements concerning the centre of gravity of the breech block with reference to the barrel and, in particular, to the pivoting point in the wrist of the hand holding the weapon, in such manner as has been stated in the claims.

DESCRIPTION OF THE DRAWINGS

The invention is described in detail in the following with the aid of embodiment examples, referring to the attached drawings, wherein.

DESCRIPTION OF THE ILLUSTRATED EMBODIMENT

Figure 1:
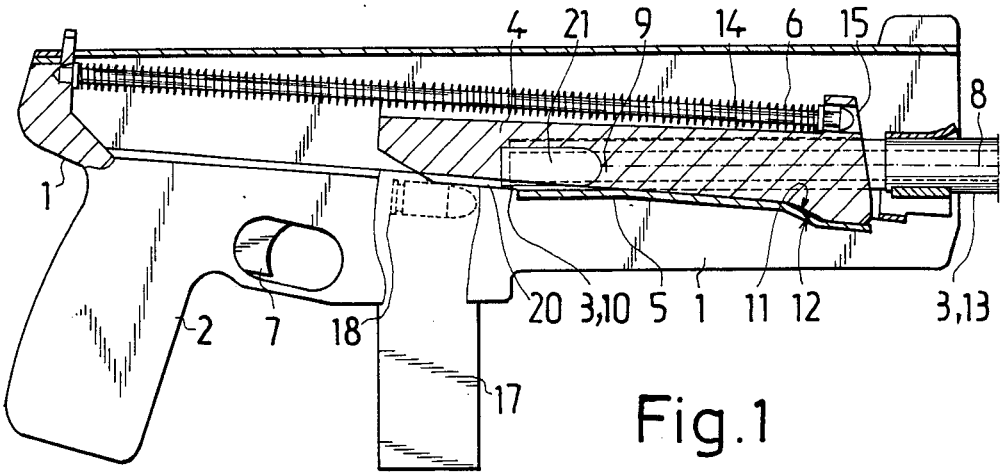
FIG. 1 presents, schematically and partly sectioned, a weapon according to the invention, in elevational view.

The mass-obturated automatic pistol depicted in FIG. 1 comprises a body 1 with handle 2, a barrel 3 joined to the body, a breech block 4 with guide 5 constituted by the body and with return spring 6, and the cocking and firing mechanism 7 (in the figure the cocking and firing mechanism has not been shown, except for the trigger, in order to better illustrate the construction). The weapon furthermore comprises an ammunition box 17 placed forward of the trigger. The breech block 4 has been disposed to move mainly encircling the barrel in a guide constituted by the body of the weapon. The guide 5 of the breech block 4, that is the lower half of the guiding chute, ascends rearward so that the rearward path of motion of the breech block deviates upward from the centre-line of the barrel 8.

As taught by the invention, the centre of gravity 9 of the sliding plug 4 is located forward of the wrist pivoting point of the hand holding the handle 2, and thus the weapon, when the breech block is in its forward position and pressed against the rear end 10 of the barrel 3. In the embodiment depicted, the breech block projects partly, preferably with its main part, forward of the rear end 10 of the barrel 3, and the centre of gravity 9 of the breech block is located forward of the rear end of said barrel, as far forward as possible.

When the weapon of the invention is used, the massive breech block 4, urged forward by the return spring 6, is cocked in its rear position with the aid of the cocking mechanism (not depicted) so that the breech block remains in the rear position, held by a cocking step or shoulder (not depicted) which is part of the firing mechanism. When the weapon is fired by its trigger, the obstacle retaining the breech block 4 in the rear position is removed and the cocking spring 6 flings the breech block forward, whereby the cartridge engager or shoulder 20 provided on the lower margin of the breech block hits against the top margin of the uppermost cartridge 18 in the ammunition box 17, which is thus pulled along with the sliding plug and thrust into the cartridge chamber 21 of the barrel 3. On reaching its forward position, i.e., when the cartridge engager 20 abuts on the rear end 10 of the barrel 3 and against the base of the cartridge that has been pushed into the chamber 21, an integral firing pin (not depicted) provided on the breech block 4 strikes against the cap of the cartridge, causing ignition of the powder charge. The energy released as the powder charge burns acts partly on the bullet, causing the bullet to fly out of the barrel, and partly on the breech block 4, giving rise to the recoil pushing the breech block back.

Figure 2:
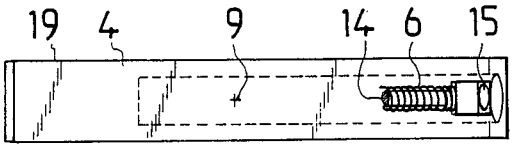
FIG. 2 shows the breech block and barrel of the weapon of FIG. 1, in top view.
Figure 3:
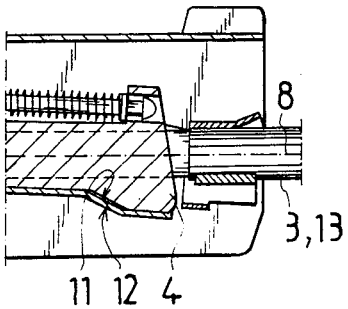
FIG. 3 presents the forward part of another embodiment of the invention, partly sectioned.

Since the rearward path of motion of the breech block 4 deviates upward from the centre-line 8 of the barrel 3 and the centre of gravity 9 of the breech block is located forward of the handle 2, the breech block is pushed by the recoil, not at all straight rearward but obliquely upward, forced thereto by the breech block guide 5. Therefore the breech block's movement that has been forced obliquely upward and the placement of the breech block's centre of gravity as taught by the invention give rise to a moment turning downwards the front end of the weapon and thus preventing the barrel from rising up during firing. The said advantageous effect is manifest both when the weapon is adjusted for continuous fire and in the case that single rounds are fired. In the embodiment of FIG. 1, the breech block 4 moves so that its main part comes to lie forward of the rear end 10 of the barrel, that is to encircle the barrel. Further, in the embodiment presented, the centre of gravity 9 of the breech block 4 is located forward of the rear end 10 of the barrel 3. FIG. 2 shows the structure of the breech block in top view. Thus, the breech block forms a central bore for the barrel 3; moreover, the breech block has been disposed to move its main part forward of the rear end 10 of the barrel, with the barrel in said bore.

In the embodiment of FIG. 1, the guide 5 of the breech block 4 forms forward of the weapon's point of support, that is of the handle 2, an obliquely downward inclined guiding surface 11, and the sliding plug forms a similarly, obliquely forward and downward running mating surface 12. The downward inclination of the guiding surface 11 and mating surface 12 deviates from the inclination of the guide 5 of the breech block 4 towards the direction of the normal on the breech block and/or the barrel, in other words, the guiding surface 11 and mating surface 12 are more steeply downward inclined than the guide 5. The said guiding surface 11 and mating surface 12 cooperate so that as the breech block moves rearward the mating surface 12 hits against the guiding surface 11, thereby causing the breech block to be pushed powerfully upward, which in its turn causes a reaction, that is, powerful downward dipping of the guiding surface 11 and thus of the weapon's front end. Therefore the action of the guiding surface 11 of the guide and that of the mating surface 12 of the breech block having an inclination steeper than the guide 5 of the breech block 4 enhances the weapon's barrel-dipping feature even further.

Figure 4:
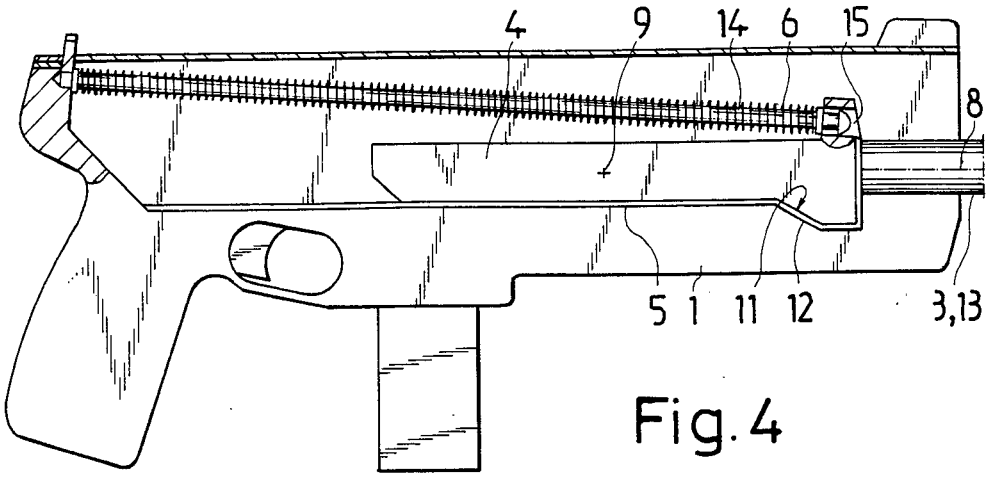
FIG. 4 presents, schematically and partly sectioned, a third weapon according to the invention in elevational view.

In the embodiment depicted in FIG. 4, the guide 5 of the breech block 4 is substantially parallel with the centre-line 8 of the barrel 3. Forward of the weapon's point of support, i.e., of the handle 2, the guide forms an obliquely forward and downward inclined guiding surface 11, and the breech block forms a corresponding, obliquely forward and downward inclined mating surface 12. In other words, the guide 5 of the breech block ascends rearward at the guiding surface 11, whereby when the breech block slides rearward as the weapon is fired, the mating surface 12 hits against the guiding surface 11, and this causes the breech block to be pushed powerfully upward. Therefore the path of the breech block will deviate upward from the centre-line 8 of the barrel. This impact of the mating surface 12 with the guiding surface 11 causes the guiding surface 11 and the forward end of the weapon to dip strongly downward.

In FIGS. 1 and 4, the weapon's cocking spring 6 with its guide spindle 14 has been attached in vertically pivoting manner in the rear portion of the weapon so that the guide spindle pushing through an aperture 15 provided in the upper part of the breech block 4 can move pivotally a certain distance upward along with the breech block during the initial period of the breech block's rearward movement, at which phase the guiding surface 11 deviating from the general inclination of the breech block's guide 5, and the corresponding mating surface on the breech block, causes the breech block to jump upward as has been described.

The guiding surface 11 of the guide 5 deviates in such manner from the centre-line and inclination of the barrel 3 that the inclination is for instance between 5° and 45°, possibly even more. The mating surface 12 on the sliding plug 4 may have an inclination consistent with that of the guiding surface on the guide 5; alternatively, the mating surface may consist of a shoulder projecting downward abruptly, e.g. at an angle of 90°, from the sliding plug. Alternatively, the mating surface of the sliding plug 4 may subtend a relatively small angle, e.g. between 5° and 30°, with the centre-line 8 of the barrel 3, and on the guide 5 has been provided a shoulder projecting abruptly upwards, e.g. at an angle of 90°, to the purpose of producing a downward turning moment.

The embodiment examples are meant to illustrate the invention without in any way confining it.

I claim:

1. An automatic hand firearm comprising a body including a handle, a barrel connected to the body, a breech block disposed within the body, a guide disposed within the body for guiding the breech block in sliding movement, biasing means for urging the breech block forwardly with respect to the barrel, said guide including an inclined guiding surface that extends upwardly and rearwardly at an acute angle with respect to the axis of the barrel and extends forwardly of the handle, said breech block when in its forward position having its center of gravity located forwardly of the handle, so that the breech block when moving rearwardly due to recoil produces a moment acting forward of the fulcrum point to force the barrel downwardly to counteract the moment tending to lift the barrel upwardly.

2. The firearm of claim 1, wherein the center of gravity of said breech block is located forwardly of the rear end of the barrel when the breech block is in its forward position.

3. The firearm of claim 1, wherein said breech block has an upwardly and rearwardly extending surface disposed to cooperate with said guiding surface when the rearwardly directed recoil force acts on said breech block.

4. The firearm of claim 1, in which the forward end of the breech block is formed with a central bore to receive the rear end of the said barrel.

5. The firearm of claim 1, wherein said guide includes a second guiding surface extending forwardly of said first guiding surface and disposed at a greater acute angle to said axis than said first guiding surface, said breech block including a first face extending upwardly and rearwardly at an acute angle with respect to said axis and disposed to mate with said first guiding surface, and said breech block having a second face extending forwardly of said first face and disposed at a greater acute angle than said first face and disposed to mate with said second surface.

* * * * *